United States Patent [19]

Brown

[11] 4,129,925

[45] Dec. 19, 1978

[54] COMBINED NAIL FILE AND WRITING IMPLEMENT CLIP ATTACHMENT

[76] Inventor: Lorin B. Brown, 1501 S. Manhattan Pl., Los Angeles, Calif. 90019

[21] Appl. No.: 797,260

[22] Filed: May 16, 1977

[51] Int. Cl.[2] ..... B43K 25/00

[52] U.S. Cl. ..... 24/11 CC; 24/11 F

[58] Field of Search ..... 24/3 R, 3 A, 3 D, 3 E, 24/3 F, 3 H, 3 J, 3 L, 3 M, 11 R, 11 CC, 11 F, 11 M

[56] References Cited

U.S. PATENT DOCUMENTS

| | | | |
|---|---|---|---|
| 1,284,718 | 11/1918 | Lasko | 24/11 F |
| 1,361,732 | 12/1920 | Johnston | 24/11 CC |
| 1,478,049 | 12/1923 | Nelson | 24/11 CC |
| 1,552,906 | 9/1925 | Beadles | 24/11 F |

FOREIGN PATENT DOCUMENTS

| | | | |
|---|---|---|---|
| 11923 of | 1914 | United Kingdom | 24/11 F |
| 420164 | 1934 | United Kingdom | 24/11 F |

*Primary Examiner*—Henry S. Jaudon
*Attorney, Agent, or Firm*—John T. Matlago

[57] ABSTRACT

A low-cost combined nail file and writing implement clip attachment is formed of a T shaped blank of sheet metal. The T shaped blank includes a short transverse strip portion connected by way of a narrowed connecting link to the top of a longitudinal strip portion which is widened and has its surface coated with an abrasive material to enable it to function as a nail file. The narrowed connecting link facilitates the shaping of the short transverse strip portion into a circular holder and the repositioning of the holder with respect to the widened longitudinal strip portion without causing the metal in the vicinity of the juncture of the strips to fracture.

1 Claim, 10 Drawing Figures

FIG. 1
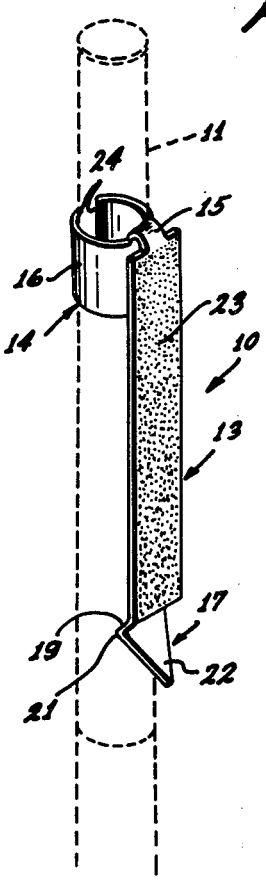
FIG. 2
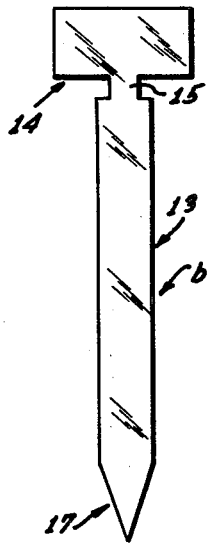
FIG. 3
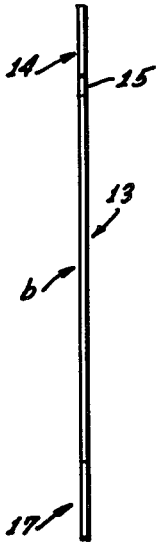
FIG. 4
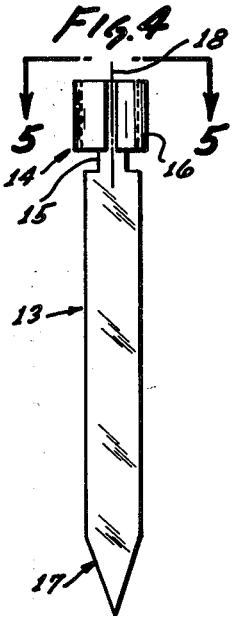
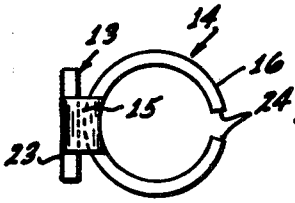
FIG. 7
FIG. 5
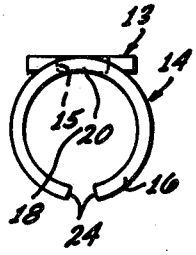
FIG. 6
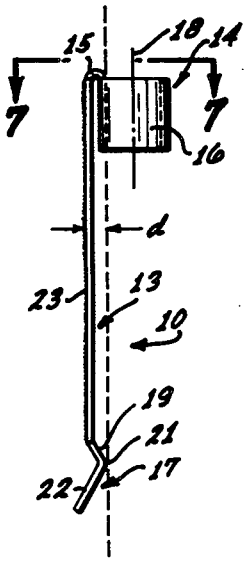
FIG. 8
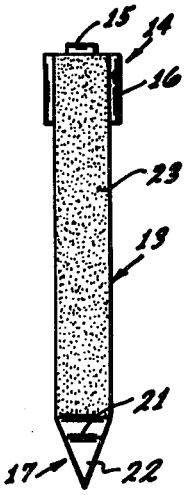
FIG. 9
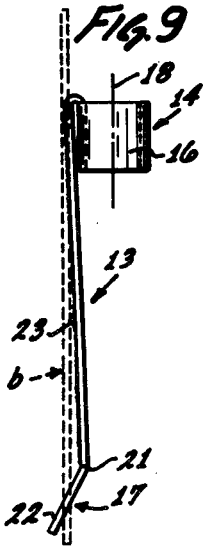
FIG. 10
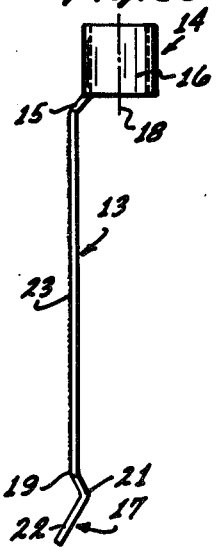

COMBINED NAIL FILE AND WRITING IMPLEMENT CLIP ATTACHMENT

BACKGROUND AND SUMMARY OF THE INVENTION

This invention relates to an improved low-cost combined nail file and clip attachment for writing implements and the like.

Inasmuch as people are constantly having difficulty keeping nail files handy for grooming their nails, it has been previously indicated in the art that a writing implement is an ideal and handy place on which to attach a fingernail file This is especially desirable since the fingernail file can be adapted to further function as a clip for attaching the writing implement to the pocket of a person's clothing, for example.

An example of the prior art is U.S. Pat. No. 2,075,932 issued to W. C. F. Ehrmann on Apr. 6, 1937. This patent discloses a relating complicated structure wherein a sheath is permanently attached to a writing implement and a tongue of a clip is disposed to be longitudinally adjustable in the sheath. Only the upper arcuate face of the tongue is abraded. The disadvantage of this prior art attachment is that it is cumbersome to use since when it is adjusted for use as a clip it is not effective as a fingernail file and when it is adjusted for use as a fingernail file it is not effective as a clip.

An example of an attachment for a writing implement which overcomes the short comings of the prior art in that it is always readily available for use as a fingernail file or as a clip is disclosed in a copending application of the present inventor, Ser. No. 702,772, filed on July 7, 1976. Therein, a removable attachment is disclosed wherein the holder therefor and the tongue for the clip which serves as a nail file are formed from separate pieces of metal. Such attachments are costly to manufacture and are not compatible for use on low-cost writing implements.

In order to minimize the cost of its manufacture, the combined nail file and clip attachment of the present invention is formed from a T shaped blank stamped from a thin sheet of metal. Both the tongue of the clip whose outer surface is coated with an abrading material to enable it to function as a nail file and the holder for the clip which is circularly formed to embrace the cylindrical body of the writing implement are integrally formed from the T shaped blank. In order to provide a sufficiently wide surface as needed to serve as a nail file, the longitudinal strip of the T shaped blank is necessarily made wider than tongues of conventional clips. Hence, although in a conventional T shaped blank the transverse strip is joined directly to the upper end of the longitudinal strip portion, when the latter is widened a problem is created in forming the transverse strip portion into the circular holder for engaging the cylindrical body of the writing implement. This is because the widened longitudinal strip portion makes it difficult to curve the transverse strip portion as needed to form the circular holder, while at the same time keeping the longitudinal strip portion flat as desired for a nail file. Moreover, when using a widened longitudinal strip portion on the T shaped blank, it is difficult if not impossible to form the transverse strip portion into a circular holder and reposition the holder thereafter relative to the longitudinal strip portion without causing the metal in the vicinity of the juncture of these strips to fracture.

The nail file clip attachment of the present invention overcomes this difficulty by employing a T shaped blank in which the short transverse strip portion is not joined directly onto the upper end of the widened longitudinal strip portion but is joined, rather, by way of a narrowed connecting link.

Accordingly, one of the objects of the present invention is to modify a T shaped blank when used to form a nail file and clip attachment so as to permit the longitudinal strip portion thereof to be widened for use as the nail file.

Another object of the present invention is to provide a low-cost combined nail file and clip attachment for a writing implement which is formed from a modified T shaped blank of thin sheet metal.

Still another object of the present invention is to provide for joining a short transverse strip portion to the upper end of a longitudinal strip portion by use of an integral narrowed connecting link which permits the transverse strip portion to be curved and repositioned relative to the longitudinal strip portion to provide a combined nail file and clip attachment for a writing implement.

With these and other objects in view, the invention consists in the construction, arrangement and combination of the various parts of the device whereby the objects contemplated are attained as hereinafter set forth, pointed out in the appended claims and illustrated in the accompanying drawings.

BRIEF DESCRIPTION OF THE DRAWINGS

FIG. 1 is a perspective view of the preferred embodiment of the combined nail file and writing implement clip attachment of the present invention;

FIG. 2 shows a blank of sheet metal from which the combined nail file and writing implement clip attachment in FIG. 1 is made;

FIG. 3 is a side view of the blank shown in FIG. 2;

FIG. 4 is a view of the blank of FIG. 2 after the transverse strip portion on the upper end thereof has been curved to form the arcuate arms of a circular holder;

FIG. 5 is an end view as taken along line 5—5 in FIG. 4;

FIG. 6 is a side view of the attachment in FIG. 1 as formed from the blank in FIG. 2;

FIG. 7 is an end view as taken along line 7—7 in FIG. 6;

FIG. 8 is a front view of the attachment in FIG. 6 as formed from the blank in FIG. 2;

FIG. 9 is a side view of a modified embodiment of the combined nail file and writing implement clip attachment as formed from the blank in FIG. 2; and FIG. 10 is a side view of a further modified embodiment of the combined nail file and writing implement clip attachment as formed from the blank in FIG. 2.

DETAILED DESCRIPTION OF THE INVENTION

Referring to the drawings, FIG. 1 shows a preferred embodiment of the combined nail file and writing implement clip attachment 10 of the present invention removably mounted on the upper body 11 of a typical writing implement illustrated in dotted lines. The attachment 10 which is made of sheet metal includes a widened rectangularly shaped longitudinal strip portion 13 joined at its upper end by way of an integrally formed narrowed rectangularly shaped connecting link or neck 15 to a short rectangularly shaped transverse strip portion 14 which has been formed into a circular holder 16. The pointed lower end portion 17 of the longitudinal strip portion 13 is angularly bent first inwardly at point 19 and then outwardly to form a corner bearing point 21 which contacts the body 11 of the writing implement. The outer flat surface of the longitudinal strip portion 13 is coated with an abrasive material 23 or otherwise abraded.

FIG. 2 shows a blank b stamped from a thin flat sheet of metal such as steel from which the attachment 10 of the present invention is formed. The blank b includes the short transverse strip portion 14 from which the holder 16 is to be formed, the longitudinal strip portion 13 on the upper end of which the strip portion 14 is joined by the narrowed connecting link 15, and the pointed end portion 17 located on the lower end of the longitudinal strip portion 13. It should be noted that the longitudinal strip portion 13 is two to three times wider than the tongue of a conventional clip for a writing implement.

The portions of the blank are shaped to form the combined nail file and writing implement clip attachment 10 by first rounding the transverse strip portion 14 to form the pair of arcuate arms of circular holder 16 having an axis 18. As shown in FIG. 5, the opposing ends 24 of the pair of arcuate arms are spaced apart. It should now be clear from FIG. 4 that the narrowed connecting link 15 which has a width and length approximately one half to one third the width of the longitudinal strip portion 13, facilitates the circular rounding of the transverse strip portion 14. This is because the shape of the initially flat link 15 closely conforms with a short arcuate portion 20 of the wall of the circular holder 16 (FIG. 5) so that it is only slightly deformed during this step of the manufacture. The narrowed connecting link 15 further facilitates the bending thereof back on itself to enable the holder 16 to be repositioned without fracturing the metal in the vicinity of the juncture such that it is disposed in an inverted position adjacent the upper side of the longitudinal strip portion 14, as shown in FIG. 6.

To complete the forming from the blank b of the combined nail file and writing implement clip 10 shown in FIG. 6, the pointed end portion 17 of the flat longitudinal strip portion 13 is first bent at point 19 inwardly at approximately 45°. Then the pointed terminating end 22 thereof is bent outwardly at approximately 30° to thereby form the corner bearing point 21 which contacts the body 11. Thus the bearing point 21 on the lower end and the bent connecting link 15 on the upper end of the longitudinal strip portion 13 serve to hold the strip portion 13 spaced a distance of approximately 0.10 of an inch from the body 11 of the writing implement (FIG. 6).

The coating 23 of abrasive material is provided on the outer surface of the longitudinal strip portion 13. This abrasive coating 23 enables the flat longitudinal strip portion 13 to serve as a nail file for dressing one's fingernails while the angularly outwardly extending pointed terminating end 22 serves as a nail cleaner, i.e., as a pointed element for use in cleaning under one's fingernails. It should be appreciated that the elongated body 11 of the writing implement conveniently serves as a handle for manipulating the fingernail file 13. Also, the nail file structural properties of the attachment 10 do not in any way interfere with the handling and attaching of the writing implement during normal usage thereof.

Inasmuch as it is desired to be able to further cheapen the cost of the combined nail file and writing implement clip attachment by minimizing the number of steps needed for its manufacture, when it is to be mated with a less expensive writing implement, FIGS. 9 and 10 show modified embodiments that are simpler to manufacture than the one illustrated in FIG. 6.

Thus, in the embodiment of FIG. 9, after the holder 16 is formed (FIG. 4) it is repositioned by bending the link 15 such that it lies in an inverted position on the back of the upper end of the longitudinal strip portion 13, and such that the plane of the longitudinal strip portion 13 is slightly inclined relative to the axis 18 of the circular holder 16. Such a positioning of the holder 16 requires only one bend to be made on the lower pointed end portion 17 of blank b to provide the corner bearing point 21 and to provide the angularly outwardly extending pointed terminating end 22.

FIG. 10 shows a further modified embodiment which is simplified in that after the upper transverse strip portion 14 has been curved to form the holder 16 (FIG. 4) the connecting link 15 is merely bent so as to be disposed at an angle of 45 degrees relative thereto. Such a bending operation serves to offset the longitudinal strip portion 13 away from the axis 18 of the holder 16 while both the strip portion 13 and the holder 16 are maintained in an upright position, i.e., the axis 18 of the holder is maintained parallel to the plane of the strip portion 13. In FIG. 10, the pointed lower end portion 17 of the longitudinal strip portion 13 is then angularly bent in the manner previously described in connection with FIG. 6 to form the bearing point 21 which bears against the surface of the body 11 of the writing implement when the combined nail file and clip attachment is mated thereon. It should be evident that the modified embodiment in FIG. 10 can be formed with simpler tooling since there is no need to invert the holder 16.

While in order to comply with the statute the invention has been described in language more or less specific as to structural features, it is to be understood that the invention is not limited to the specific features shown but that the means and construction herein disclosed comprise a preferred form of putting the invention into effect, and the invention is therefore claimed in any of its forms or modifications within the legitimate and valid scope of the appended claims.

What is claimed is:

1. A removable clip attachment for a writing implement or the like formed from a single piece of sheet metal, said clip attachment comprising:

a rectangularly shaped flat longitudinal strip portion having a pointed portion on the lower end thereof;

a split circular holder portion having an opening the diameter of which is substantially equal to the width of said longitudinal strip portion, said circular holder portion disposed opposite the back of the upper end of said longitudinal strip portion with its sidewall offset from and extending parallel to the plane of said longitudinal strip portion; and a connecting link portion integrally joining the upper end of said longitudinal strip portion to the upper end of said circular holder portion, said connecting link portion having a width and length dimension on the order of one-half to one-third the width dimension of said longitudinal strip portion and having its sides forming substantially square corners where they join the upper end of said circular holder portion, and said connecting link portion having the shape of a semicircle with the upper end of said longitudinal strip portion and the upper end of said circular holder portion lying tangent to the ends thereof;

said longitudinal strip portion having the pointed portion on the lower end thereof bent sharply inwardly toward the axis of said circular holder portion and then sharply outwardly to form a bearing corner with the terminating end of said pointed lower end portion extending angularly outwardly;

whereby when said circular holder portion is fitted on the writing implement said bearing corner contacts the outer surface of the writing implement with a slight bearing pressure while said longitudinal strip portion is supported parallel to but offset from the surface of said writing implement; and the outer surface of said longitudinal strip portion is abraded for use as a fingernail file.

* * * * *